US010070694B2

(12) United States Patent
Schreiner

(10) Patent No.: US 10,070,694 B2
(45) Date of Patent: Sep. 11, 2018

(54) SHOELACE SECURING DEVICE

(71) Applicant: Kevin E. Schreiner, Henderson, NV (US)

(72) Inventor: Kevin E. Schreiner, Henderson, NV (US)

( * ) Notice: Subject to any disclaimer, the term of this patent is extended or adjusted under 35 U.S.C. 154(b) by 36 days.

(21) Appl. No.: 15/092,187

(22) Filed: Apr. 6, 2016

(65) Prior Publication Data

US 2017/0290392 A1 Oct. 12, 2017

(51) Int. Cl.
*A43C 7/00* (2006.01)

(52) U.S. Cl.
CPC ..... *A43C 7/00* (2013.01)

(58) Field of Classification Search
CPC ..... A43C 7/00
See application file for complete search history.

(56) References Cited

U.S. PATENT DOCUMENTS 3,138,839 A 6/1964 Durant
3,430,303 A * 3/1969 Wakefield ..... A43C 7/00 24/269
3,845,575 A * 11/1974 Boden ..... A43C 7/00 24/115 M
5,903,959 A 5/1999 Leonardi
6,018,851 A * 2/2000 Anscher ..... F16G 11/101 24/115 G
6,038,746 A * 3/2000 Anscher ..... F16G 11/101 24/115 G
6,457,214 B1 * 10/2002 Boden ..... F16G 11/101 24/115 M
D560,477 S * 1/2008 Yoshie ..... D8/383
D586,648 S * 2/2009 Yoshie ..... D8/385
7,574,786 B2 * 8/2009 Cheng ..... A43C 1/00 24/115 G
8,069,810 B2 * 12/2011 Petzl ..... G10K 5/00 116/137 R
8,904,605 B2 12/2014 Kawaguchi
2009/0064473 A1 * 3/2009 Chan ..... A43C 7/00 24/712.5
2009/0094798 A1 * 4/2009 Yao ..... A43C 1/00 24/115 G
2010/0257701 A1 * 10/2010 Gammell ..... A43C 1/00 24/115 G
2013/0283639 A1 10/2013 Williams et al.

* cited by examiner

*Primary Examiner* — David M Upchurch
(74) *Attorney, Agent, or Firm* — Jason P. Webb; Pearson Butler

(57) ABSTRACT

A shoelace securing device including a lace lock through which a pair of shoelaces are disposed and secured. The lace lock includes a pair of locking apertures and a spring. The shoelace securing device includes a plurality of protrusions extending from the lace lock about which a pair of shoelaces are wrapped. The shoelace securing device includes a shield member selectably coupleable over the plurality of protrusions thereby trapping any shoelaces wrapped around the plurality of protrusions. The shield member includes a non-front aperture for shoelaces to extend through.

15 Claims, 11 Drawing Sheets

SHOELACE SECURING DEVICE

BACKGROUND OF THE INVENTION

Field of the Invention

The present invention relates to shoelaces, specifically a shoelace securing device.

Description of the Related Art

Shoelaces are a system commonly used to secure shoes, boots and other footwear. They typically consist of a pair of strings or cords, one for each shoe, finished off at both ends with stiff sections, known as aglets. Each shoelace typically passes through a series of holes, eyelets, loops or hooks on either side of the shoe. Loosening the lacing allows the shoe to open wide enough for the foot to be inserted or removed. Tightening the lacing and tying off the ends secures the foot within the shoe.

When a shoelace is secured with a knot, the lace is crimped or squashed. Primarily it is this which stops the lace from coming undone. In effect the lace is narrower inside the knot than it is on the loose end and the loose end cannot make itself smaller and slide though the knot. Generally a flat tubular lace will stay tied more easily than a round lace with a core because the flat lace can be more crimped within the knot. Most laces however are round and have core of cotton yarn especially boot laces. For these to stay tied securely the core on the inside of the lace must be soft and compressible. A secondary factor is laces coming undone is the knot itself slipping this is due to a lack of friction. Cotton laces have a rough surface and will make a more reliable knot compared to polyester (the most common yarn used in shoelaces), in addition a lace can be smooth or have a coarse surface which will also affect performance. Finishing processes are available including waxing and silicone treatments which enhance friction and stop knot slippage. These are important design factors in the manufacture of hiking boot laces.

Shoelaces are typically tied off at the top of the shoe using a simple bow knot. Besides securing the shoe, this also takes up the length of shoelace exposed after tightening. The common bow consists of two half knots tied one on top of the other, with the second half-knot looped in order to allow for quick untying. When required, the knot can be readily loosened by pulling one or both of the loose ends.

When tying the half-knots, a right-over-left half knot followed by a left-over-right half knot (or vice versa) forms a square or reef knot, a fairly effective knot for the purpose of tying shoelaces. However, tying two consecutive right-over-left half knots (or two consecutive left-over-right half knots) forms the infamous granny knot, which is much less secure. Most people who use it will find themselves regularly retying their shoelaces. If the loops lie across the shoe (left to right), the knot is probably a square knot. If they lie along the shoe (heel to toe), the knot is probably a granny knot.

Some improvements have been made in the field. Examples of references related to the present invention are described below in their own words, and the supporting teachings of each reference are incorporated by reference herein:

U.S. Pat. No. 8,903,959, issued to Leonardi, discloses a shoe lace fastener is set forth which includes a base member and a clamp member. The base member has an opening defining a pair of bearing surfaces and the clamp member has legs adapted to be received in the opening to trap and secure lace ends threaded through holes in the legs.

U.S. Pat. No. 8,904,605, issued to Kawaguchi, discloses a cord lock includes a male tool and a female tool that receives a part of the male tool by pressing the male tool against a biasing force of a biasing device, and so as to match cord eyelets formed in sides of the male tool and the female tool each other at a predetermined pressing position of the male tool. An engaging part that is engaged with an engaged part of the female tool by the biasing force of the biasing device to prevent the male tool from slipping out of a position before the pressing operation, is formed on a side of the male tool intersecting a direction in which the eyelet passes through, and at a position closer to a pressing backward side than a hole edge located on a pressing forward side of the eyelet.

U.S. Patent Application Publication No.: 2009/0094798, by Yao, discloses a low profile cord lock includes a female cord lock member, which has two insertion holes at two sides of an accommodation chamber thereof and two locating grooves in the insertion holes at the bottom side, a male cord lock member, which is received in the accommodation chamber and has a through hole and two protruding blocks that are respectively inserted into the insertion holes of the female cord lock member to allow vertical movement of the male cord lock member relative to the female cord lock member between a first position where the through hole is in axial alignment with the insertion holes for the insertion of a cord member and a second position where the through hole is deviated from the insertion holes and the inserted cord member is clocked, and a spring member mounted supported between the female cord lock member and the male cord lock member to hold male cord lock member in the second position.

U.S. Patent Application Publication No.: 2013/0283639, by Williams et al., discloses a device for rapidly securing and obscuring footwear laces includes a strap having a cinching device such as a cord lock; a plurality of tubular lace restraints along the length of the strap; and a means for connecting one end of the strap to the other, so as to secure the device around a wearer's ankle with the laces obscured beneath. Laces travel the majority of the length of the strap, and can stay engaged with the laces even when footwear is not being worn. A user can insert foot into footwear, tighten laces by pulling on ends, cinch laces in tightened position by engaging cinching device, wrap strap with laces around ankle, and secure in place around ankle or ankle of footwear.

The inventions heretofore known suffer from a number of disadvantages which include being limited in use, being difficult to use, being unduly complex, being expensive, being inconvenient, requiring a knot or tie, being slow to use/operate, requiring modified laces, not working with existing shoes, requiring shoe modifications, being messy in appearance, looking substantially different from existing knot-based shoe tying systems, failing to hide laces, not saving time, not being secure, and not being safe.

What is needed is a shoelace securing device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available shoelace securing devices.

Accordingly, the present invention has been developed to provide an efficient and effective device for securing shoelaces.

According to one embodiment of the invention, there is a shoelace securing device that may include a lace lock through which a pair of shoelaces may be disposed and secured. The lace lock may include a pair of locking apertures. The lace lock may include a spring.

The shoelace securing device may include a plurality of protrusions that may extend from the lace lock about which a pair of shoelaces may be wrapped. The plurality of protrusions may include a center post that may be flanked by a pair of flanking posts. Each flanking post may include a plurality of notches opposite the center post.

The shoelace securing device may include a shield member that may be selectably coupleable over the plurality of protrusions thereby trapping any shoelaces wrapped around the plurality of protrusions. At least one of the plurality of protrusions may selectably couple to the shield member. The plurality of protrusions may include a forked post with notches opposite the lace lock that may selectably couple to the shield member. The shield member may include a non-front aperture for shoelaces to extend through. The shield member may include a pair of front flanges, that may be opposite each other, and each may be configured to trap a shoelace there under.

According to one embodiment of the invention, there is a method of tying a shoelace that may include the step of providing a shoelace securing device. The securing device may include a lace lock through which a pair of shoelaces may be disposed and secured. The securing device may include a plurality of protrusions extending from the lace lock about which a pair of shoelaces may be wrapped. The securing device may include a shield member that may be selectably coupleable over the plurality of protrusions thereby trapping any shoelaces wrapped around the plurality of protrusions. The shield member may include a pair of front flanges, opposite each other, and each configured to trap a shoelace there under.

The method of tying a shoelace may include the step of extending a pair of shoelaces through the lace lock. The method may include the step of wrapping laces around the plurality of protrusions; such that a pair of lace loops are formed. The method may include the step of securing the shield member over the plurality of protrusions and adjusting the size of the lace loops to desired tightness. The method of tying a shoelace may include the step of tucking laces loops under front flange.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
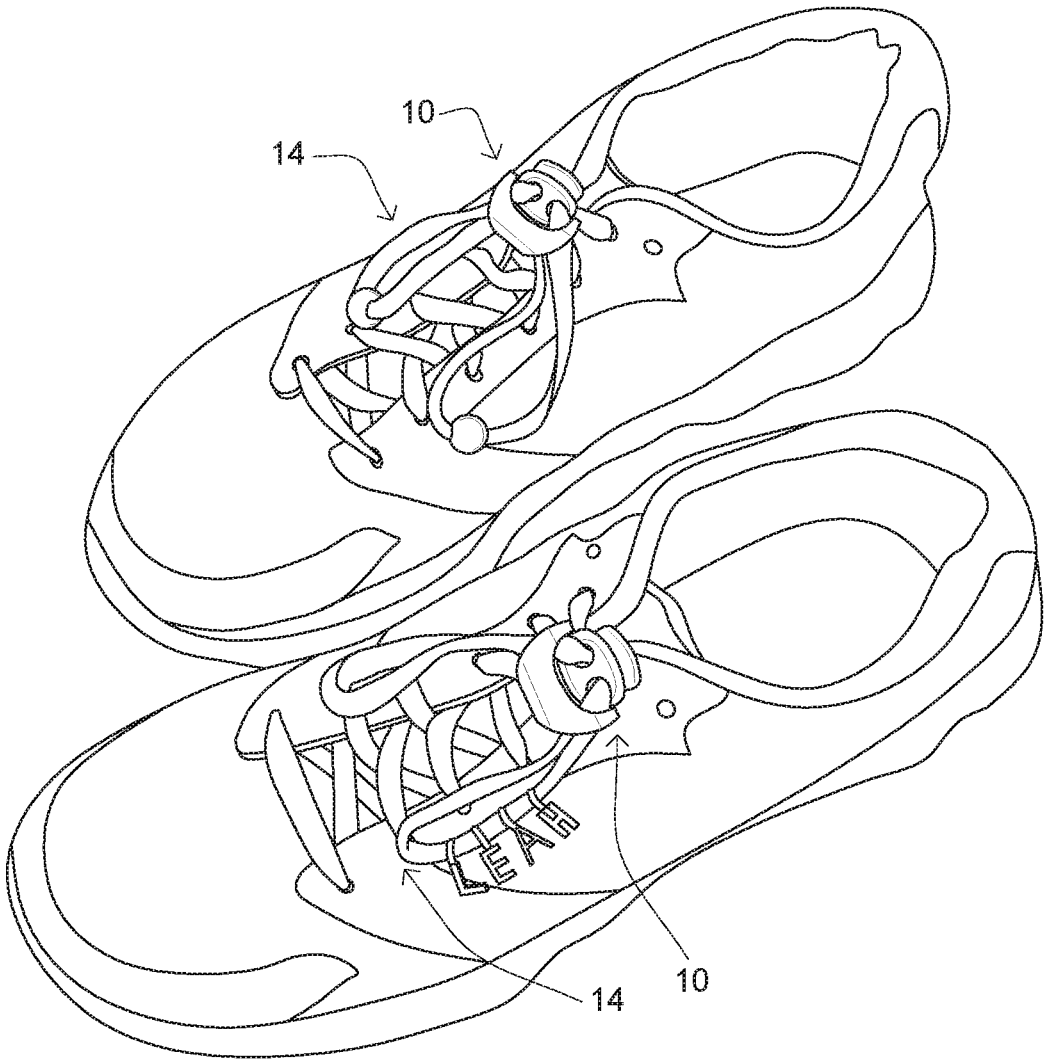
FIG. 1 is a perspective view of a pair of shoelace securing devices coupled to respective shoelaces on shoes, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a pair of shoelace securing devices coupled to respective shoelaces on shoes, according to one embodiment of the invention. There is shown a pair of shoes each including shoelaces 14, wherein a shoelace securing device 10 is coupled thereto in a manner that visually simulates the appearance of shoes being tied in a manner that leaves exposed loops.

The illustrated pair of shoes are intended to be worn on a wearer's feet. Each pair of shoes includes shoelaces 14. Each shoelace is secured to the respective shoe by operation of a shoelace securing device 10 in conjunction with lace holes through which the shoelace is disposed. The shoelace securing device 10 secures and stores the shoelaces to secure the shoe to the wearer's foot. The shoelace securing device 10 includes a lace lock through which the pair of shoelaces 14 are disposed and secured therethrough. The lace lock includes a pair of locking apertures. The shoelace securing device 10 includes a shield member that is selectably coupleable over the lace lock thereby trapping any shoelaces wrapped there around.

According to one embodiment of the invention, there is a shoelace securing device that allows a wearer to secure a shoelace to a shoe without having to tie them. Tying shoelaces requires time and attention that could better be directed elsewhere, especially in situations where time/attention is at a premium, such as but not limited to timed events, sporting events, races, or even simply a busy individual/day. Further, tying shoelaces can be frustrating and, for some, is challenging. Thus the illustrated shoelace securing device may reduce frustration and allow individuals to wear shoes with laces when they might not otherwise be able to do so. The illustrated shoelace securing device does not leave the ends of the shoelaces dangling and therefore is safer than similar systems that leave dangling lace ends. Also, the illustrated device is usable with existing shoes without having to modify the shoes and therefore is not limited in application to a subset of laced shoes.

The illustrated shoelace securing device includes a lace lock that secures the laces in a configuration that can hold the device firmly against the top of the shoe while allowing for loops to extend therefrom in a manner similar to how loops extend with traditional tying techniques. Therefore, on a cursory examination of the shoes, the shoes appear to be completely normal. Such a shoelace securing device may include a push-release spring locking aperture lace lock that the cords of the shoelace go through and that thereby secures the laces in a such a configuration.

Some methods of securing shoelaces require that the user either modify the laces or use modified laces in order to deal with the long ends of the laces. The illustrated device works with existing shoes and shoelaces, wherein no modification of either is needed. In doing so, the illustrated device gathers the laces behind a shield and reduces their effective length in a manner that is similar to a tied lace but leaves no exposed lace ends and presents a sharp, clean and simple appearance.

According to one embodiment of the invention, there is a shoelace securing device that provides one or more of the following benefits: being easier, being convenient, wherein no tying is required, being faster, not requiring modified laces, working with existing shoes and laces, looking neat, looking sharp, hiding laces and/or lace ends, saving time, being more secure, and/or being safer.

According to one embodiment of the invention, there is a shoelace securing device that includes a spring-lock lace lock in combination with a plurality of notched projections for securing and storing laces. The device includes a shield that hides the notched projections (and the lace regions wound thereupon) while in use. Forward loops may be created when the device is in operation.

According to one embodiment of the invention, there is a shoelace securing device includes a shield. The shield may be an enclosure structure for enclosing a portion of one or more projections that may couple to the shield. A connection between the shield and such one or more projections may include one or more of the following connections: snap-fit, friction fit, screw, clip, tied elastic band, no notches, pegs, and the like and combinations thereon. The projections themselves may be elongated members shaped and oriented to allow for laces to be wound therearound. There may be a single projection or multiple projections. The projection(s) may include structure to hold lace wraps in place including but not limited to notches, bristles, cavities, wedges, additional projections, inelastically deformable materials (e.g. gummy-type materials) that withdraw under pressure from lace wraps), contact adhesive layer(s), and the like and combinations thereof.

The illustrated device includes a lace lock that secures to the laces that extend therethrough, thus holding them in place and preventing the laces from loosening. The lace lock may be a spring-lock lace lock such that a user may be able to press down against the force of the spring to deactivate the lock and allow for the laces to more freely travel through the lace lock. Accordingly, the device may be tightened or loosened easily by simply deactivating the lace lock when desired, but the "rest" position of the lace lock is to lock the laces in place.

According to one embodiment of the invention, there is a shoelace securing device configured to provide an easy alternative to tying/untying shoelaces, an easy method to direct shoelaces into an attractive loop configuration and secure the ends of the shoelace, the ability to manipulate the length of the loop configuration with the ability to utilize different length shoelaces, the ability to have interchangeable colors or design, and/or the ability to attach objects/jewelry to the forward loop lace in a semi-permanent manner.

This present invention provides an alternative to tying shoelaces or shoestrings. The device not only secures a typical shoelace to hold the shoe in place, it also directs the lace into an attractive loop configuration and secures the ends of the shoelace, it allows for the addition of different designs, colors and jewelry. This is all accomplished using the existing shoelace found on virtually any shoe, no specialized lace is required.

It's important that the shoelace is tight enough to secure the shoe to the foot and that the end of the lace is secure to prevent it from tripping the user. This illustrated device accomplishes both and is easy to apply and once in place may quickly and securely tighten and loosen the laces of a shoe for easy and secure, on and off.

Advantageously, there is illustrated a shoelace securing device which may facilitate tying and untying the shoestring and secure the ends of the shoelaces in place.

Figure 2:
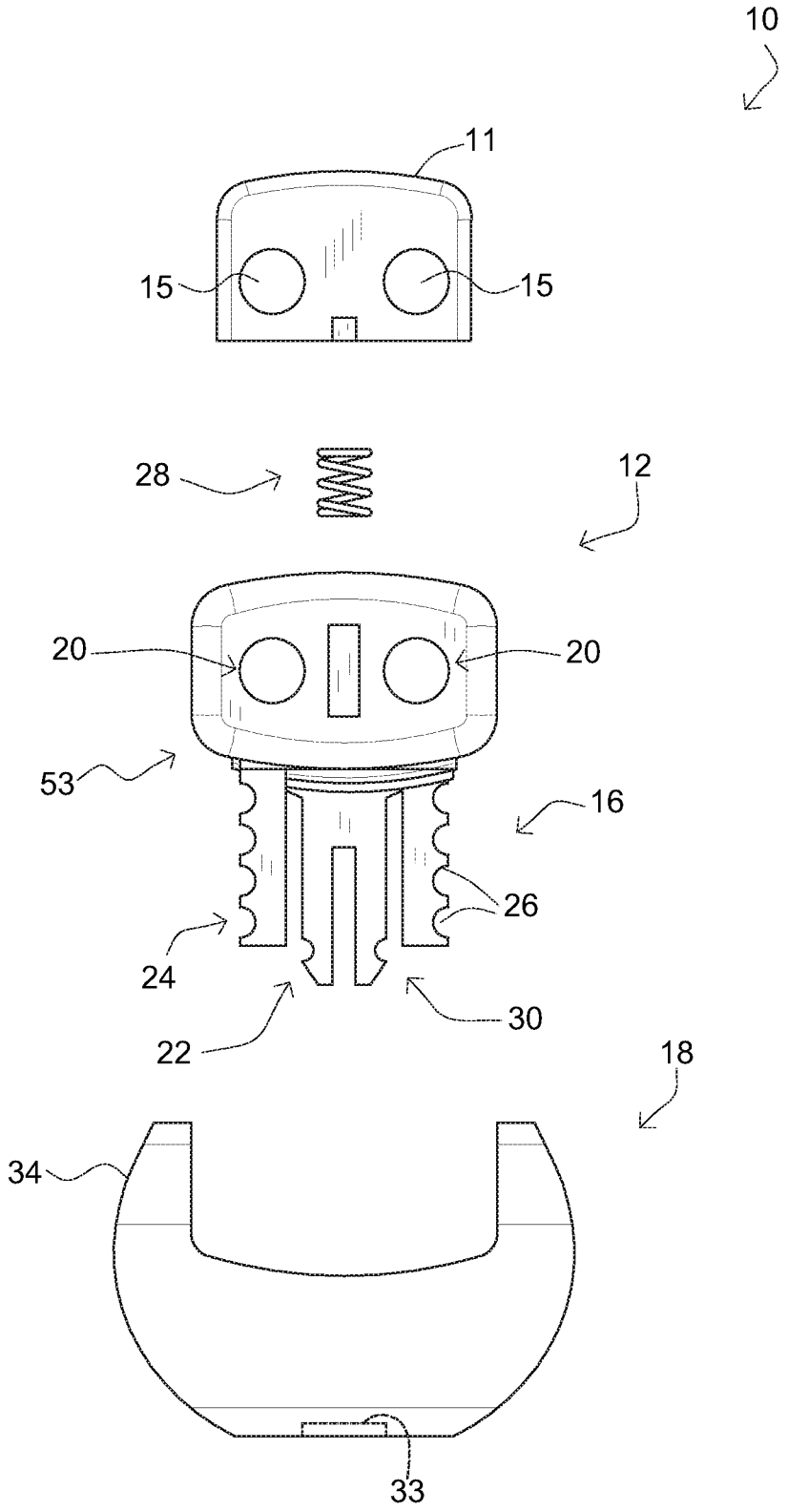
FIG. 2 is a front elevational exploded-view of a shoelace securing device, according to one embodiment of the invention.

FIG. 2 is a front elevational exploded-view of a shoelace securing device, according to one embodiment of the invention. There is shown a shoelace securing device 10 including a lace lock 12 selectably coupleable to a shield member 18.

Figure 4:
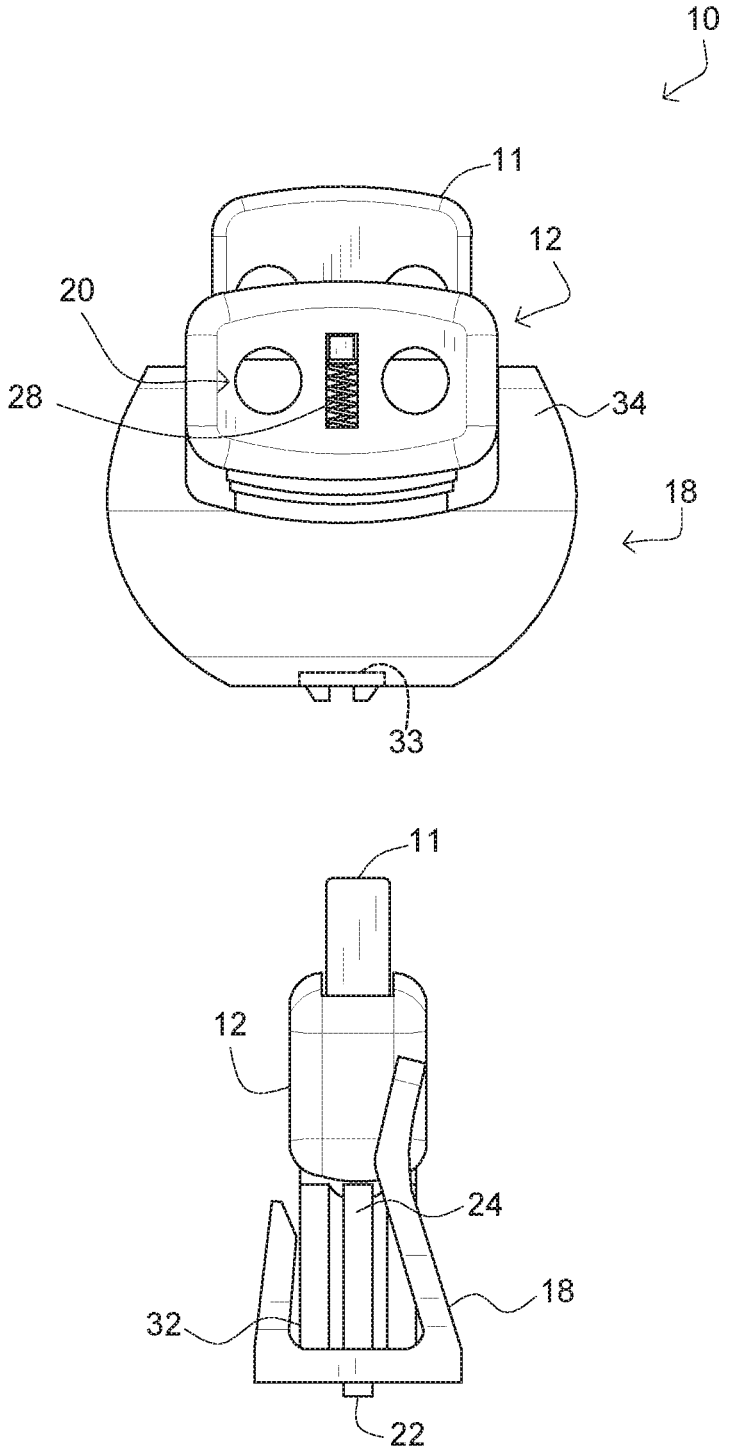
FIG. 4 is a pair of views of a lace lock selectably coupled to a shield member, according to one embodiment of the invention.

The illustrated shoelace securing device 10 shows a key-shaped lace lock 12 (key-shaped, wherein the illustrated lace lock has structure that is shaped as a bow with a blade/shaft extending therefrom, this being similar to the bow and blade/shaft of a common house-key wherein the bow is larger than the blade/shaft such that a slot that will mate with the blade/shaft will be too small for the bow to fit thereinside and thus when the blade/shaft is disposed within such as slot, the bow will protrude therefrom in a manner similar to how the bow of a key protrudes from a keyhole when the blade/shaft of the key is placed inside the keyhole, See FIG. 4) through which a pair of shoelaces may be disposed and secured. The lace lock 12 includes a pair of locking apertures 20 through a receiver member 53 of the lace lock 12, the receiver member 53 being the bow of the key-shaped lace lock and the plurality of protrusions 16 being the blade/shaft thereof, for receiving a pair of shoelaces. The lace lock 12 includes a spring 28 or a biased member, wherein the spring 28 compresses and decompresses to allow a shoelace to pass therethrough or to lock a shoelace from passing therethrough. There is a push-button member 11 with apertures 15 therethrough that substantially match apertures 20 in a receiver member 53 of the lace lock 12 into which the push-button member 11 may be disposed. A spring 28 rests between the push-button member 11 and the receiver member 53 of the lace lock 12 such that when the spring is extended, the apertures of the push-button member are not substantially aligned with the apertures of the receiver member and that when the spring is compressed the apertures are substantially aligned. Accordingly, any flexible material (e.g. laces) that extend through the apertures of both the push-button member may be trapped thereby when the spring is at rest and may be not trapped when the spring is compressed, generally by depressing the push-button member more fully into the receiver member.

The illustrated shoelace securing device 10 includes a plurality of protrusions 16 extending from the lace lock 12 about which a pair of shoelaces are wrapped. The illustrated plurality of protrusions 16 includes a center post 22 flanked by a pair of flanking posts 24. Each flanking post 24 includes a plurality of notches 26 opposite the center post 22, thereby providing structure about which to wrap laces. The protrusions are shaped and oriented to fit within the illustrated shield, including when laces are wrapped thereabout, such that the shield can cover the protrusions and provide a clean image while preventing the laces from unwrapping from the protrusions.

The illustrated shoelace securing device 10 includes a shield member 18 selectably coupleable over the plurality of protrusions 16 thereby trapping any shoelaces wrapped around the plurality of protrusions 16. At least one of the plurality of protrusions 16 is selectably coupled to the shield member 18. The illustrated plurality of protrusions 16 includes a forked post 30 with notches opposite the lace lock 12 selectably coupled to the shield member 18 through a bottom aperture 33. The shield member 18 includes a non-front aperture for shoelaces to extend through (See side-view of FIG. 3, element 32). The illustrated shield member 18 includes a pair of front flanges 34, opposite each other, and each are configured to trap a shoelace there under.

According to one embodiment of the invention, there is a shoelace securing device 10 that may include an actuation mechanism or button to actuate a spring 28 of a lace lock 12. The actuation mechanism partially rests within the lace lock 12 when in operation and is tensioned upward by the spring 28. The actuation mechanism may include an outward protrusion (e.g. on a front side of the lace lock 12) or some similar structure, thereby keeping the actuation mechanism from pushing out of the top of the lace lock 12. Pushing down on the actuation mechanism's top aligns a pair of locking apertures of the actuation mechanism with a pair of locking apertures of the lace lock 12. Shoelaces may then be fed through the pair of locking apertures; and releasing the actuation mechanism allows the spring 28 to tension and secure the shoelaces to the shoelace securing device 10.

Figure 3:
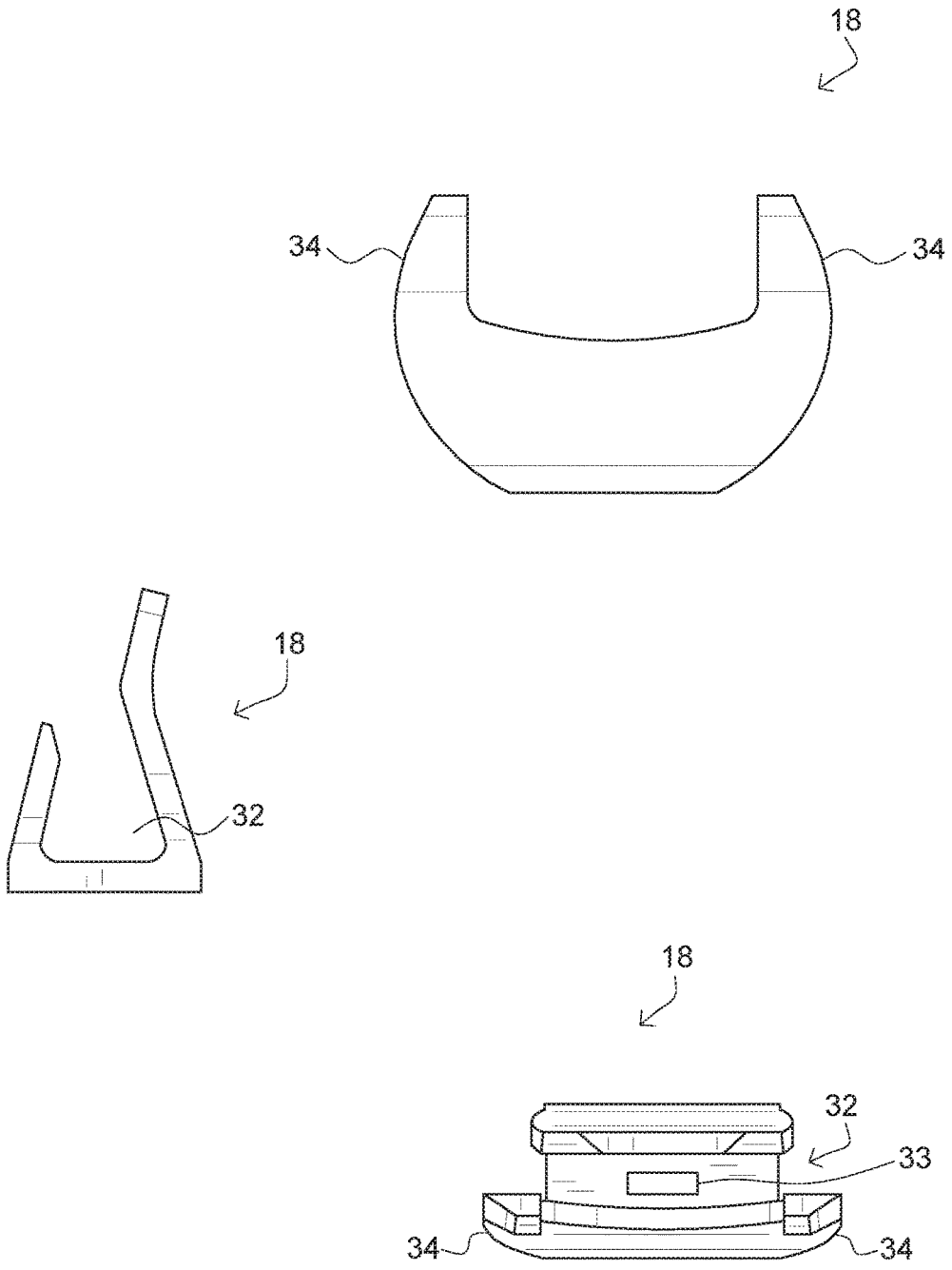
FIG. 3 illustrates a side elevational view, a top plan view, and a front elevational view of a shield member, according to one embodiment of the invention.

FIG. 3 illustrates a side elevational view, a top plan view, and a front elevational view of a shield member, according to one embodiment of the invention. There is shown a shield member 18 including a non-front aperture 32 and a pair of front flanges 34.

The illustrated shield member 18 is selectably coupleable over a plurality of protrusions of a lace lock of a shoelace securing device. The shield member 18 is designed to trap any shoelaces wrapped around the plurality of protrusions of the lace lock and secure then, just like tying a knot. The shield member 18 includes a non-front aperture 32 for shoelaces to extend through. The shield member 18 includes a pair of front flanges 34, opposite each other, and each configured to trap a shoelace there under. The front flanges 34 and the non-front aperture 32 force the shoelaces to the side of the shield member 18 and thereby create an appearance of a regular shoelace knot. The shield member 18 includes an aperture (bottom aperture 33) for a center post of the plurality of protrusions to extend therethrough.

FIG. 4 is a pair of views of a lace lock selectably coupled to a shield member, according to one embodiment of the invention. There is shown a shoelace securing device 10 including a lace lock 12 selectably coupled to a shield member 18.

The illustrated shoelace securing device 10 secures a shoelace to a shoe. The device 10 includes a lace lock 12 through which a pair of shoelaces may be disposed and secured. The lace lock 12 includes a pair of locking apertures 20 and a spring 28. The shoelace securing device 10 includes a plurality of protrusions (not shown) extending from the lace lock 12 about which a pair of shoelaces are wrapped. The plurality of protrusions includes a center post 22 flanked by a pair of flanking posts 24. Each flanking post 24 includes a plurality of notches opposite the center post 22.

The shoelace securing device 10 includes a shield member 18 selectably coupleable over the plurality of protrusions thereby trapping any shoelaces wrapped around the plurality of protrusions. The illustrated shield includes a bottom aperture 33 through which a protrusion may extend into and clip thereto. In the illustrated embodiment, at least one of the plurality of protrusions is selectably coupled to the shield member 18 thereby. The shield member 18 includes a non-front aperture 32 for shoelaces to extend through. The shield member 18 includes a pair of front flanges 34, opposite each other, and each configured to trap a shoelace there under.

Figure 5:
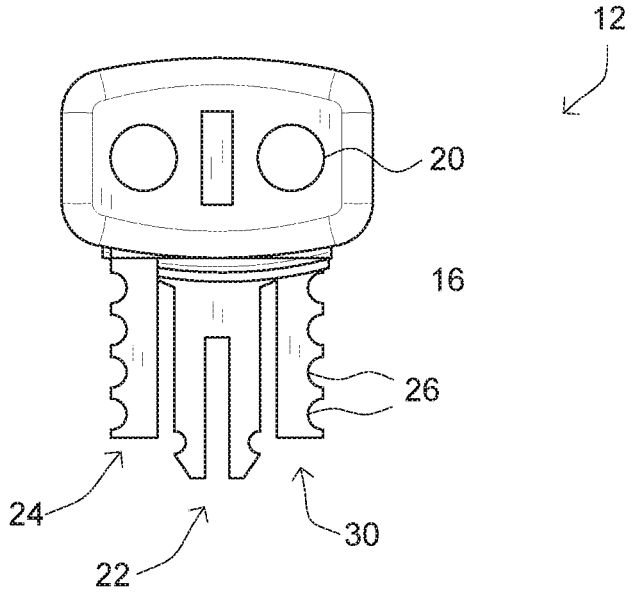
FIG. 5 is a front elevational view and a side elevational view of a lace lock, according to one embodiment of the invention.
Figure 5:
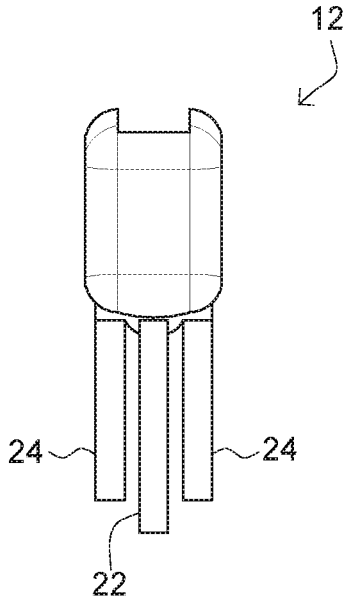

FIG. 5 is a front elevational view and a side elevational view of a lace lock, according to one embodiment of the invention. There is shown a lace lock 12 of a shoelace securing device, wherein the lace lock 12 includes a plurality of protrusions 16 extending from the lace lock 12.

The illustrated lace lock 12 is designed for a pair of shoelaces to be disposed and secured there through. The lace lock 12 includes a pair of locking apertures 20. The lace lock 12 includes a plurality of protrusions 16 extending from the lace lock 12 about which a pair of shoelaces is wrapped. The plurality of protrusions 16 includes a center post 22 flanked by a pair of flanking posts 24. Each flanking post 24 includes a plurality of notches 26 opposite the center post 22. Each notch 26 is shaped to receive a shoelace. The notches 26 of the flanking posts 24 may be staggered so that the shoelaces may be wrapped there around without overlapping or being wrapped around the shoelace instead of the notches or protrusions. The plurality of notches 26 or protrusions includes a forked post 30 with notches opposite the lace lock 12 that selectably couples to the shield member.

Figure 6:
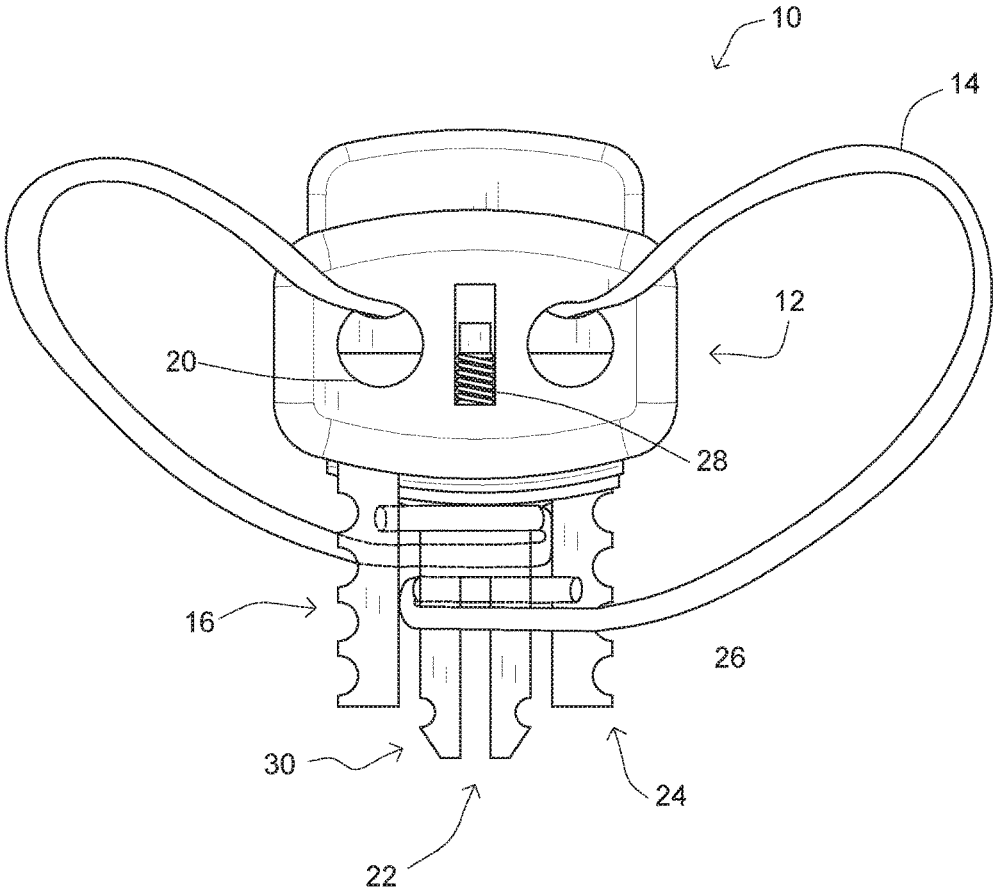
FIG. 6 is a front elevational view of a lace lock with a shoelace extending therethrough, according to one embodiment of the invention.

FIG. 6 is a front elevational view of a lace lock with a shoelace extending therethrough, according to one embodiment of the invention. There is shown a shoelace 14 threaded through a lace lock 12 and wrapped around a plurality of protrusions 16 of a shoelace securing device 10.

The illustrated shoelace securing device 10 is designed to secure a shoelace to a shoe. The device 10 includes a lace lock 12 through which a pair of shoelaces 14 are disposed and secured. The lace lock 12 includes a pair of locking apertures 20. The lace lock 12 includes a spring 28. The shoelace securing device 10 includes a plurality of protrusions 16 extending from the lace lock 12 about which a pair of shoelaces 14 is wrapped. The plurality of protrusions 16 includes a center post 22 flanked by a pair of flanking posts 24. Each flanking post 24 includes a plurality of notches 26 opposite the center post 22. The plurality of protrusions 16 includes a forked post 30 with notches opposite the lace lock 12 that selectably couples to a shield member (not shown).

Figure 7:
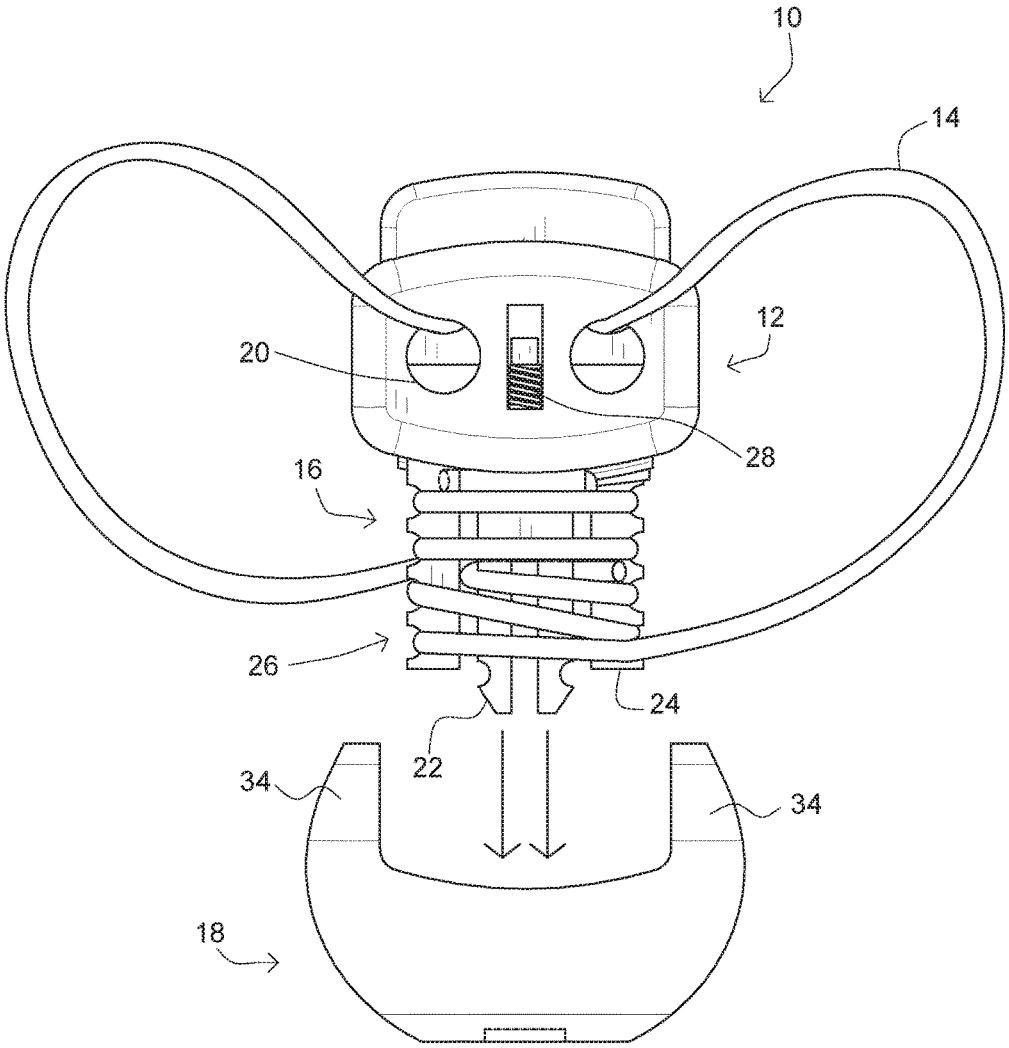
FIG. 7 is a front elevational view of a shoelace securing device with a shoelace extending from a lace lock, according to one embodiment of the invention.

FIG. 7 is a front elevational view of a shoelace securing device with a shoelace extending from a lace lock, according to one embodiment of the invention. There is shown a pair of shoelaces 14 secured to a shoelace securing device 10, wherein the device 10 includes a lace lock 12 and a shield member 18.

The illustrated shoelace securing device 10 includes a lace lock 12 through which a pair of shoelaces 14 are disposed and secured. The lace lock 12 includes a pair of locking apertures 20 and a spring 28 to secure the pair of shoelaces 14 there between. The shoelace securing device 10 includes a plurality of protrusions 16 extending from the lace lock 12 about which the pair of shoelaces 14 are wrapped. The plurality of protrusions 16 includes a center post 22 that is flanked by a pair of flanking posts 24. Each flanking post 24 includes a plurality of notches 26 opposite the center post 22.

The shoelace securing device 10 includes a shield member 18 that is selectably coupleable over the plurality of protrusions 16 thereby trapping any shoelaces 14 wrapped around the plurality of protrusions 16. At least one of the plurality of protrusions 16 is selectably coupled to the shield member 18. The shield member 18 includes a non-front aperture for shoelaces 14 to extend through. The shield member 18 includes a pair of front flanges 34, opposite each other, and each flange 34 is configured to trap the shoelace 14 there under.

Figure 8:
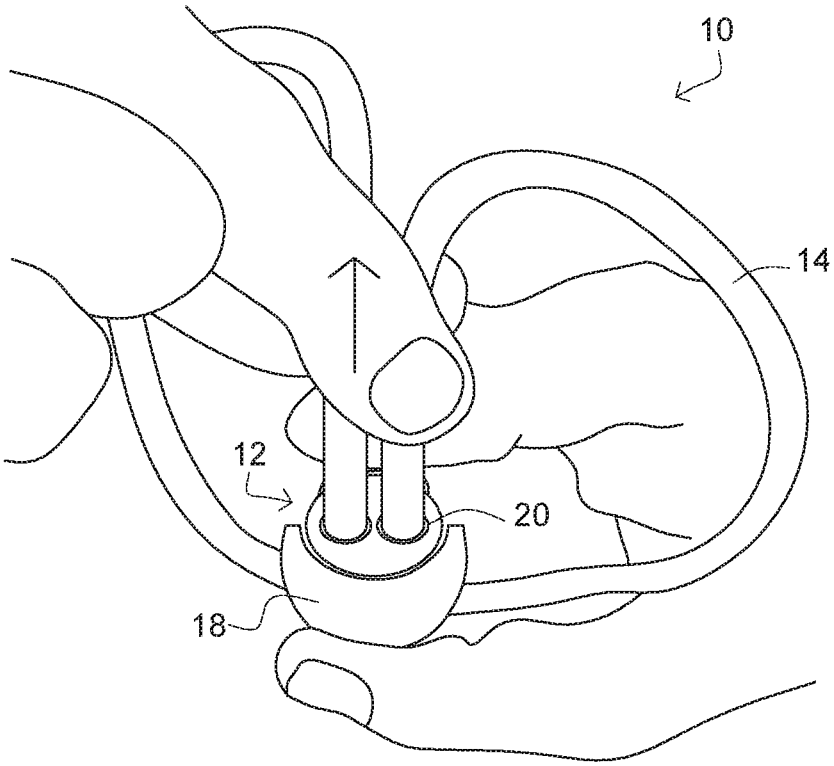
FIG. 8 illustrates a perspective view of a shoelace being pulled through a lace lock, according to one embodiment of the invention.

FIG. 8 illustrates a perspective view of a shoelace being pulled through a lace lock, according to one embodiment of the invention. There is shown a shoelace 14 threaded through a pair of locking apertures 20 of a lace lock 12 of a shoelace securing device 10.

The illustrated shoelace securing device 10 includes a lace lock 12 through which a pair of shoelaces 14 are disposed and secured. The lace lock 12 includes a pair of locking apertures 20; wherein the locking apertures 20 are shaped and designed to receive the pair of shoelaces 14. The shoelaces 14 are configured to extend through the pair of locking apertures 20. The shoelace securing device 10 includes a shield member 18 that is selectably coupleable to the lace lock 12 thereby trapping any shoelaces 14 wrapped therein.

Figure 9:
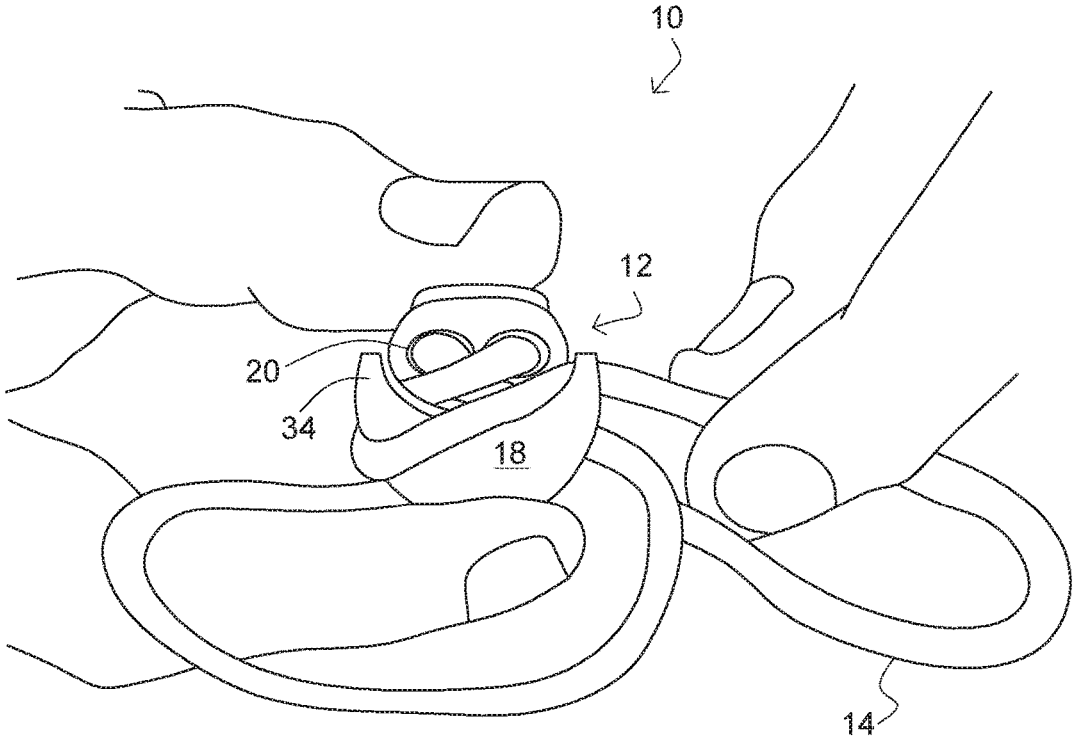
FIG. 9 illustrates a perspective view of a shoelace being secured to a lace lock, according to one embodiment of the invention.

FIG. 9 illustrates a front perspective view of a shoelace 14 being secured to a shoelace securing device 10, according to one embodiment of the invention. The illustrated wrap/tuck differs from that shown in FIG. 1 and is an optional variant of how one may wrap/tuck shoelaces in cooperation with the shield 18 of a shoelace securing device 10. This optional variant may be used when increased securing may be desired and/or wherein a different visual effect regarding the laces is desired.

The illustrated wrap/tuck shows a partial wrap/tuck wherein the shoelace portion extending from the right-most aperture is crossed over the other shoelace portion. Both shoelace portions are tucked behind opposite front flanges 34 of the shield 18. The right-most shoelace portion that is crossed over the left-most shoelace portion wraps around a front of the corresponding flange, crosses the front of the shield and then is tucked behind the opposite flange 34 over the top of the left-most shoelace portion. To complete the wrap/tuck, a user would then wrap the left-most shoelace portion around a front of the corresponding flange, cross the front of the shield and then tuck behind the opposite flange over the top of the right-most shoelace portion. The resulting configuration provides a different loop appearance from that shown in FIG. 1 and increases the security of the laces by allowing the wrap/tuck to operate in a manner similar to a knot, yet still being easy to undo. During typical everyday use, it is expected that one would simply tuck shoelace portions behind respective flanges as is shown in FIG. 1.

Figure 10:
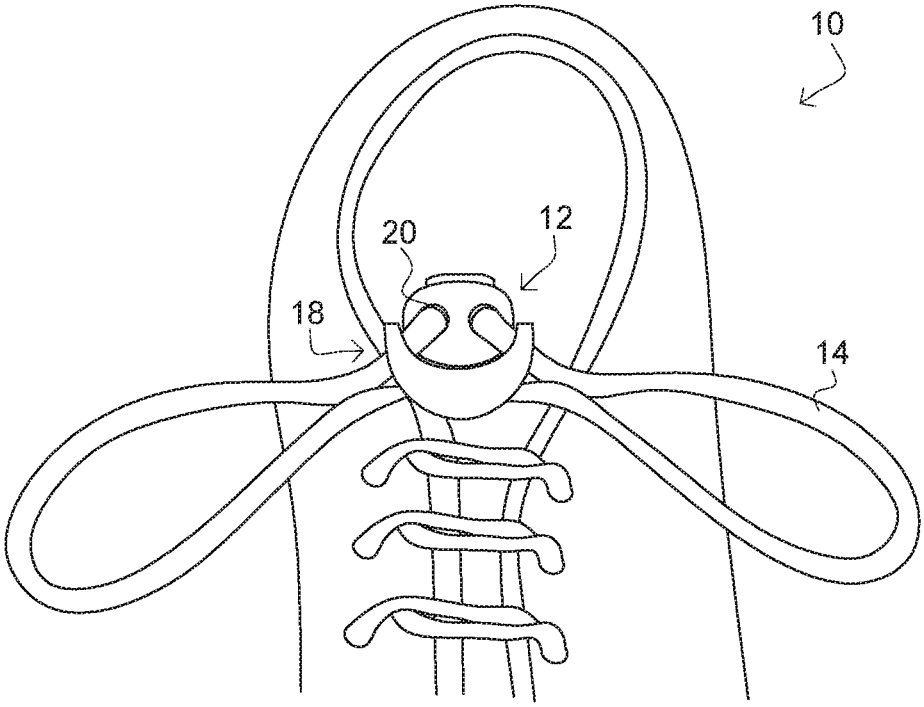
FIG. 10 is a perspective view of a shoelace securing device selectably coupled to a shoelace, according to one embodiment of the invention.

FIG. 10 is a perspective view of a shoelace securing device selectably coupled to a shoelace, according to one embodiment of the invention. There is shown a pair of shoelaces 14 secured to a shoelace securing device 10 by a lace lock 12 and a shield member 18.

The illustrated shoelace securing device 10 includes a lace lock 12 through which a pair of shoelaces 14 are disposed and secured. The lace lock 12 includes a pair of locking apertures 20; wherein the locking apertures 20 are shaped and designed to receive the pair of shoelaces 14. The shoelaces 14 are configured to extend through the pair of locking apertures 20. The shoelace securing device 10 includes a shield member 18 that is selectably coupleable to the lace lock 12 thereby trapping any shoelaces 14 wrapped therein.

Figure 11:
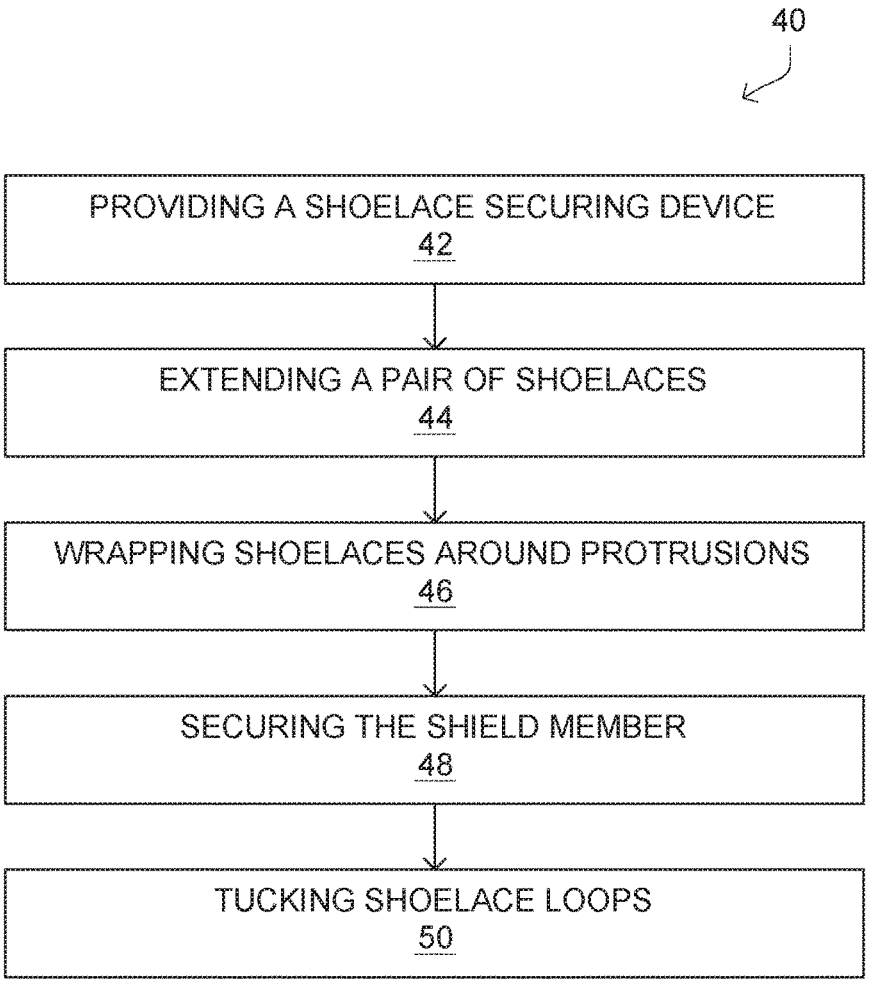
FIG. 11 is a flowchart of a method of securing a shoelace, according to one embodiment of the invention.

FIG. 11 is a flowchart of a method of securing a shoelace, according to one embodiment of the invention. There is shown a method of tying a shoelace using a shoelace securing device.

The illustrated method of tying a shoelace 40 includes the step of providing a shoelace securing device 42. The securing device includes a lace lock through which a pair of shoelaces are disposed and secured. The securing device includes a plurality of protrusions extending from the lace lock about which a pair of shoelaces are wrapped. The securing device includes a shield member selectably coupleable over the plurality of protrusions thereby trapping any shoelaces wrapped around the plurality of protrusions. The shield member includes a pair of front flanges, opposite each other, and each configured to trap a shoelace there under.

The method of tying a shoelace 40 includes the step of extending a pair of shoelaces through the lace lock 44. The method 40 includes the step of wrapping laces around the plurality of protrusions; such that a pair of lace loops are formed 46. The method 40 includes the step of securing the shield member over the plurality of protrusions and adjusting the size of the lace loops to desired tightness 48. The method of tying a shoelace 40 includes the step of tucking laces loops under front flange 50.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrated shield has a particular shape and configuration, many variations thereon may be utilized, including but not limited to shields that are transparent/translucent, having cage-style bars, including a set of interchangeable shields that may have different characteristics, shields of different colors/materials, and the like and combinations thereof.

Additionally, although the figures illustrate a two-holed spring-lock lace lock, such a lace lock may be a lever-lock, snap-lock, friction-fit apertures, may include only one hole for the lock, a lock with ratcheting rollers, hole(s) with friction enhanced surfaces that contact the laces, and the like and combinations thereof.

It is also envisioned that the described invention may operate with any manner of shoelaces other than typical un-modified laces, including but not limited to modified laces, laces designed to have no loops (e.g. laces with spiral elastic memory of spiral windings), elastic laces, laces made from gummy materials, chain laces, and the like and combinations thereof.

It is expected that there could be numerous variations of the design of this invention. An example is that the shield may include one or more logos, statements, images, symbols, colors, light emitting devices, decorations, or the like. Another example is that the apertures through which the laces are disposed may be of a non-circular/oval shape, such as but not limited to being square, rectangular, irregular, polygonal, half-circular, and the like and combinations thereof.

Finally, it is envisioned that the components of the device may be constructed of a variety of materials including but not limited to plastics, resins, metals, ceramics, woods, natural fibers, composite materials, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A shoe lace securing device, comprising:

a) a lace lock through which a pair of shoelaces can be disposed and secured, the lace lock including:
   a receiver member having receiver apertures,
   a push-button member having button apertures disposed within the receiver member, and
   a spring member coupled between the receiver member and the push-button member such that in an unbiased mode the receiver apertures are unaligned with the button apertures such that they trap a shoe lace disposed therethrough, but in a biased mode the receiver apertures are sufficiently aligned with the button apertures such that a shoe lace may pass freely therethrough;

b) a pair of protrusions extending from the lace lock parallel to each other and orthogonal to the receiver apertures about which a pair of shoelaces can be wrapped; and c) a C-shaped shield member having both a C-shaped front and a hook-shaped side that is selectably coupleable and selectably removable therefrom over the pair of protrusions thereby trapping any shoelaces wrapped around the pair of protrusions the shield member shaped to receive the pair of protrusions and clip thereto.

2. The device of claim 1, wherein the receiver apertures and the button apertures are disposed on opposite sides of the spring member.

3. The device of claim 1, further including a center post flanked by the pair of protrusions.

4. The device of claim 3, wherein the center post is forked, thereby having two forked members, and shaped to extend through a bottom aperture of the shield member wherein notches on an outside edge of each of the forked members clip to the bottom aperture.

5. The device of claim 1, wherein the spring is parallel to the pair of protrusions.

6. The device of claim 4, wherein the center post is parallel to the pair of protrusions, but not co-planar with the pair of protrusions.

7. The device of claim 6, wherein the shield member includes a pair of front flanges disposed opposite each other and each on an opposite side of the lace lock when the shield member is coupled to the lace lock and spaced from the lace lock such that laces may be wrapped about the pair of front flanges.

8. The device of claim 1, wherein the shield member includes a non-front aperture for shoelaces to extend through.

9. The device of claim 1, wherein the shield member includes a pair of front flanges, opposite each other, and each configured to trap a shoelace there under.

10. A shoe lace securing device, comprising:

a) a key-shaped lace lock, having a bow and a shaft extending from the bow, the shaft comprising a pair of parallel prongs, through which a pair of shoelaces can be disposed and secured, wherein the lace lock includes a pair of locking apertures disposed through the bow of the key-shaped lace lock;

b) a shield member that is separate from the key-shaped lace lock and that includes a receiving slot into which the prongs of the key-shaped lace lock may be inserted and a clip that clips to cooperating clip structure of the key-shaped lace lock when the key-shaped lace lock is inserted therein, the shield member including a cover that covers the prongs when the key-shaped lace lock is clipped into the shield member, and wherein the bow is shaped to not fit into the receiving slot when the prongs are disposed therein.

11. The device of claim 10, wherein the shaft includes a center post flanked by the pair of parallel prongs.

12. The device of claim 11, wherein the lace lock includes a spring-loaded button that actuates along a direction parallel to the pair of parallel prongs.

13. The device of claim 12, wherein the shaft includes a forked post with notches opposite the lace lock that selectably clips to the shield member.

14. The device of claim 13, wherein the shield member includes a non-front aperture for shoelaces to extend through.

15. The device of claim 14, wherein the shield member includes a pair of front flanges, opposite each other, and each configured to trap a shoelace there under.

* * * * *